US008999141B2

(12) United States Patent
Kokayeff et al.

(10) Patent No.: US 8,999,141 B2
(45) Date of Patent: Apr. 7, 2015

(54) THREE-PHASE HYDROPROCESSING WITHOUT A RECYCLE GAS COMPRESSOR

(75) Inventors: Peter Kokayeff, Naperville, IL (US); John Anthony Petri, Palatine, IL (US)

(73) Assignee: UOP LLC, Des Plaines, IL (US)

( * ) Notice: Subject to any disclaimer, the term of this patent is extended or adjusted under 35 U.S.C. 154(b) by 1011 days.

(21) Appl. No.: 12/165,499

(22) Filed: Jun. 30, 2008

(65) Prior Publication Data

US 2009/0321310 A1 Dec. 31, 2009

(51) Int. Cl.
*C10G 65/02* (2006.01)

(52) U.S. Cl.
CPC ..... *C10G 65/02* (2013.01)

(58) Field of Classification Search
CPC ..... C10G 65/02; C10G 65/04; C10G 65/12; C10G 69/02; C10G 2300/4018; C10G 2300/4081
USPC ..... 208/58, 59
See application file for complete search history.

(56) References Cited

U.S. PATENT DOCUMENTS

| | | | | |
|---|---|---|---|---|
| 2,578,704 | A | 12/1951 | Houdry | |
| 2,878,179 | A | 3/1959 | Hennig | |
| 2,943,999 | A | 7/1960 | Moore | |
| 3,072,465 | A | 1/1963 | Benichou et al. | |
| 3,128,242 | A | 4/1964 | Bergstrom et al. | |
| 3,130,006 | A | 4/1964 | Rabo et al. | 23/110 |
| 3,130,145 | A | 4/1964 | Buckhannan | |
| 3,142,545 | A | 7/1964 | Raarup et al. | |
| 3,154,481 | A | 10/1964 | Brooks | |
| 3,328,290 | A | 6/1967 | Hengstebeck | |
| 3,592,757 | A | 7/1971 | Baral | |
| 3,623,974 | A | 11/1971 | Mounce et al. | |
| 3,668,112 | A | 6/1972 | Parker et al. | 208/89 |
| 3,720,602 | A | 3/1973 | Riley et al. | |
| 3,730,880 | A | 5/1973 | Van der Toorn et al. | |
| 3,981,793 | A | 9/1976 | Christie et al. | |
| 4,218,338 | A | 8/1980 | Huin et al. | |
| 4,363,718 | A | 12/1982 | Klotz | 208/110 |
| 4,419,220 | A | 12/1983 | LaPierre et al. | |

(Continued)

FOREIGN PATENT DOCUMENTS

| | | | |
|---|---|---|---|
| EP | 0225053 | A1 | 10/1987 |
| EP | 1394237 | A1 | 3/2004 |

(Continued)

OTHER PUBLICATIONS

Green, Don W.; Perry, Robert H. (2008). Perry's Chemical Engineers' Handbook (8th Edition) . . . McGraw-Hill. Online version available at: http://www.knovel.com/web/portal/browse/display?_EXT_KNOVEL_DISPLAY_bookid=2203&VerticalID=0.*

(Continued)

*Primary Examiner* — Michelle Stein

(57) ABSTRACT

In general, methods of hydroprocessing a hydrocarbonaceous feed stock are provided that do not use a costly recycle gas compressor, but are still able to use the more efficient reaction systems provided in a substantially three-phase hydroprocessing zone. The method combines a substantially liquid-phase hydroprocessing zone with the substantially three-phase hydroprocessing zone in a manner so that the hydrogen requirements for both reaction zones can be provided from an external source thereto without the use of a hydrogen recycle or recycle gas compressor to the substantially three-phase reaction zone.

17 Claims, 1 Drawing Sheet

(56) References Cited

U.S. PATENT DOCUMENTS

| | | | | |
|---|---|---|---|---|
| 4,501,926 | A | 2/1985 | LaPierre et al. | |
| 4,554,065 | A | 11/1985 | Albinson et al. | |
| 4,555,325 | A | 11/1985 | Wolowski et al. | |
| 4,676,887 | A | 6/1987 | Fischer et al. | 208/61 |
| 4,678,764 | A | 7/1987 | Le et al. | |
| 4,683,214 | A | 7/1987 | Angevine et al. | |
| 4,689,138 | A | 8/1987 | Miller | |
| 4,735,780 | A | 4/1988 | Noe | |
| 4,738,766 | A | 4/1988 | Fischer et al. | 208/68 |
| 4,746,495 | A | 5/1988 | Mingaud et al. | |
| 4,750,357 | A | 6/1988 | Anderson et al. | |
| 4,788,378 | A | 11/1988 | Chang et al. | |
| 4,789,457 | A | 12/1988 | Fischer et al. | 208/68 |
| 4,828,677 | A | 5/1989 | Fischer et al. | 208/89 |
| 4,855,530 | A | 8/1989 | LaPierre et al. | |
| 4,859,311 | A | 8/1989 | Miller | |
| 4,867,862 | A | 9/1989 | Ziemer | |
| 4,919,789 | A | 4/1990 | Fischer et al. | 208/61 |
| 4,921,594 | A | 5/1990 | Miller | |
| 4,943,366 | A | 7/1990 | Fischer et al. | 208/68 |
| 4,954,241 | A | 9/1990 | Kukes et al. | |
| 4,960,504 | A | 10/1990 | Pellet et al. | |
| 4,962,269 | A | 10/1990 | LaPierre et al. | |
| 5,082,986 | A | 1/1992 | Miller | |
| 5,114,562 | A | 5/1992 | Haun et al. | |
| 5,135,638 | A | 8/1992 | Miller | |
| 5,149,421 | A | 9/1992 | Miller | |
| 5,246,566 | A | 9/1993 | Miller | |
| 5,282,958 | A | 2/1994 | Santilli et al. | |
| 5,290,427 | A | 3/1994 | Fletcher et al. | |
| 5,403,469 | A | 4/1995 | Vauk et al. | |
| 5,403,470 | A | 4/1995 | Kokayeff et al. | 208/212 |
| 5,447,621 | A | 9/1995 | Hunter | |
| 5,527,448 | A | 6/1996 | Morel et al. | 208/211 |
| 5,718,820 | A | 2/1998 | Morel et al. | 208/15 |
| 5,720,872 | A | 2/1998 | Gupta | |
| 5,833,837 | A | 11/1998 | Miller | |
| 5,877,350 | A | 3/1999 | Langer et al. | |
| 5,904,835 | A | 5/1999 | Thakkar | |
| 5,976,351 | A | 11/1999 | Apelian et al. | |
| 5,980,729 | A | 11/1999 | Kalnes et al. | |
| 6,036,844 | A * | 3/2000 | Gupta et al. | 208/49 |
| 6,106,694 | A | 8/2000 | Kalnes et al. | |
| 6,106,695 | A | 8/2000 | Kalnes et al. | |
| 6,123,835 | A | 9/2000 | Ackerson et al. | 208/213 |
| 6,200,462 | B1 * | 3/2001 | Cash et al. | 208/89 |
| 6,217,746 | B1 | 4/2001 | Thakkar et al. | |
| 6,221,239 | B1 | 4/2001 | Morel et al. | |
| 6,294,080 | B1 | 9/2001 | Thakkar et al. | 208/100 |
| 6,299,759 | B1 | 10/2001 | Bradway et al. | |
| 6,387,245 | B1 | 5/2002 | Kalnes et al. | |
| 6,402,935 | B1 | 6/2002 | Kalnes | |
| 6,428,686 | B1 | 8/2002 | Ackerson et al. | 208/213 |
| 6,444,116 | B1 | 9/2002 | Galiasso et al. | 208/58 |
| 6,497,810 | B1 | 12/2002 | Laccino et al. | |
| 6,497,813 | B2 | 12/2002 | Ackerson et al. | 208/311 |
| 6,627,778 | B2 | 9/2003 | Xu et al. | |
| 6,638,419 | B1 | 10/2003 | Da Silva et al. | 208/208 R |
| 6,645,371 | B2 | 11/2003 | Vuillemot et al. | |
| 6,656,342 | B2 | 12/2003 | Smith et al. | |
| 6,689,273 | B1 | 2/2004 | Kalnes et al. | |
| 6,702,935 | B2 | 3/2004 | Cash et al. | |
| 6,881,326 | B2 | 4/2005 | Ackerson et al. | 208/213 |
| 6,890,425 | B2 | 5/2005 | Ackerson et al. | 208/311 |
| 6,929,738 | B1 | 8/2005 | Riley et al. | |
| 7,041,211 | B2 | 5/2006 | Kalnes | |
| 7,074,320 | B2 | 7/2006 | Miller | |
| 7,078,439 | B2 | 7/2006 | Odueyungbo et al. | |
| 7,094,332 | B1 | 8/2006 | Kalnes et al. | 208/97 |
| 7,097,815 | B2 | 8/2006 | Dassori et al. | |
| 7,156,977 | B2 | 1/2007 | Wrisberg et al. | |
| 7,238,277 | B2 | 7/2007 | Dahlberg et al. | |
| 7,354,462 | B2 | 4/2008 | O'Rear | |
| 8,008,534 | B2 | 8/2011 | Petri et al. | |
| 2002/0004621 | A1 | 1/2002 | Xu et al. | |
| 2002/0148755 | A1 * | 10/2002 | Ackerson et al. | 208/209 |
| 2004/0159582 | A1 | 8/2004 | Simmons et al. | |
| 2005/0010076 | A1 | 1/2005 | Wasserscheid et al. | 585/862 |
| 2005/0082202 | A1 | 4/2005 | Ackerson et al. | 208/213 |
| 2006/0118464 | A1 | 6/2006 | Kalnes | |
| 2006/0144756 | A1 * | 7/2006 | Ackerson et al. | 208/108 |
| 2008/0023372 | A1 | 1/2008 | Leonard et al. | |
| 2008/0159928 | A1 | 7/2008 | Kokayeff et al. | |
| 2009/0095651 | A1 | 4/2009 | Leonard et al. | |
| 2009/0095652 | A1 | 4/2009 | Kokayeff et al. | |
| 2009/0095653 | A1 | 4/2009 | Kokayeff et al. | |
| 2009/0095655 | A1 | 4/2009 | Kokayeff et al. | |
| 2009/0095656 | A1 | 4/2009 | Kokayeff et al. | |
| 2009/0321319 | A1 | 12/2009 | Kokayeff et al. | |
| 2009/0326289 | A1 | 12/2009 | Petri et al. | |
| 2010/0155294 | A1 | 6/2010 | Kokayeff et al. | |

FOREIGN PATENT DOCUMENTS

| | | | | |
|---|---|---|---|---|
| EP | 0 993 498 | B1 | 8/2004 | C10G 45/22 |
| WO | 9613563 | A1 | 5/1996 | |
| WO | 9626993 | A1 | 9/1996 | |
| WO | 0034416 | A1 | 6/2000 | |

OTHER PUBLICATIONS

Ronze, "Hydrogen solubility in straight run gasoil", Chemical Engineering Science 57 (2002) 547-553.

Wache, "Improved deep desulphurisation of middle distillates by a two-phase reactor with pre-saturator", Fuel 85 (2006) 1483-1493.

Schmitz, C. et al, "Deep desulfurization of diesel oil: Kinetic studies and process-improvement by the use of a two-phase reactor with pre-saturator," Chemical Engineering Science, vol. 59, No. 14, 2004, pp. 2821-2829.

Datsevitch, L. et al., "Improvement of the deep desulfurization of diesel fuel by pre-saturation and a recycle of the liquid phase," DGMK Tagungsber., 2003, pp. 321-328, Chemical Abstracts 140(15/16), Abstract No. 255917 (2004).

Gudde, N.J. et al., "Improving deep sulfur removal from motor fuels by the use of a pre-saturator and a liquid circuit," Chemie-Ingenieur-Technik, vol. 75, No. 8, 2003, p. 1040, and English language abstract (1 page).

Boesmann, A. et al., "Deep desulfurization of diesel fuel by extraction with ionic liquids," Chem. Commun., vol. 23, 2001, pp. 2494-2495, Chemical Abstracts 136(9/10), Abstract No. 153666 (2002).

Stratiev, D. et al., "Investigation on the effect of heavy diesel fraction properties on product sulphur during ultra deep diesel hydrodesulphurization," Erdol Erdgas Kohle, vol. 122, No. 2, 2006, pp. 59-60, 62-63, Urban Verlag Hamburg/Wien GmbH, Germany.

Gatte, R. et al., "Hydrogen processing. Hydrotreating. General Process.", National Petrochemical and Refiners Association, 1999 NPRA Question and Answer Session on Refining and Petrochemical Technology, Washington, D.C., pp. 140-158.

Johnson, T.E., "Weigh options for meeting future gasoline sulfur specifications," Fuel Technology & Management, vol. 7, No. 2, pp. 16, 18 (Mar. 1997).

U.S. Appl. No. 11/300,007, filed Dec. 14, 2005, Leonard.

U.S. Appl. No. 12/495,601, filed Jun. 30, 2009, Petri.

Office Action dated Jun. 4, 2009 in U.S. Appl. No. 11/460,307, Leonard.

Applicants' Sep. 4, 2009 Response to the Jun. 4, 2009 Office Action in U.S. Appl. No. 11/460,307, Leonard.

Office Action dated Jun. 12, 2009 in U.S. Appl. No. 11/618,623, Kokayeff.

Applicants' Sep. 11, 2009 Response to the Jun. 12, 2009 Office Action in U.S. Appl. No. 11/618,623, Kokayeff.

Office Action dated Dec. 15, 2009 in U.S. Appl. No. 11/872,084, Leonard.

Applicants' Mar. 15, 2010 Response to the Dec. 15, 2009 Office Action in U.S. Appl. No. 11/872,084, Leonard.

(56) References Cited

OTHER PUBLICATIONS

Office Action dated Oct. 5, 2009 in U.S. Appl. No. 11/872,312, Kokayeff.
Applicants' Jan. 5, 2010 Response to the Oct. 5, 2009 Office Action in U.S. Appl. No. 11/872,312, Kokayeff.
Office Action dated Apr. 12, 2010 in U.S. Appl. No. 11/872,312, Kokayeff.
Applicants' Jul. 1, 2010 Response to the Apr. 12, 2010 Office Action in U.S. Appl. No. 11/872,312, Kokayeff.
U.S. Appl. No. 12/495,574, filed Jun. 30, 2009, Petri.

* cited by examiner

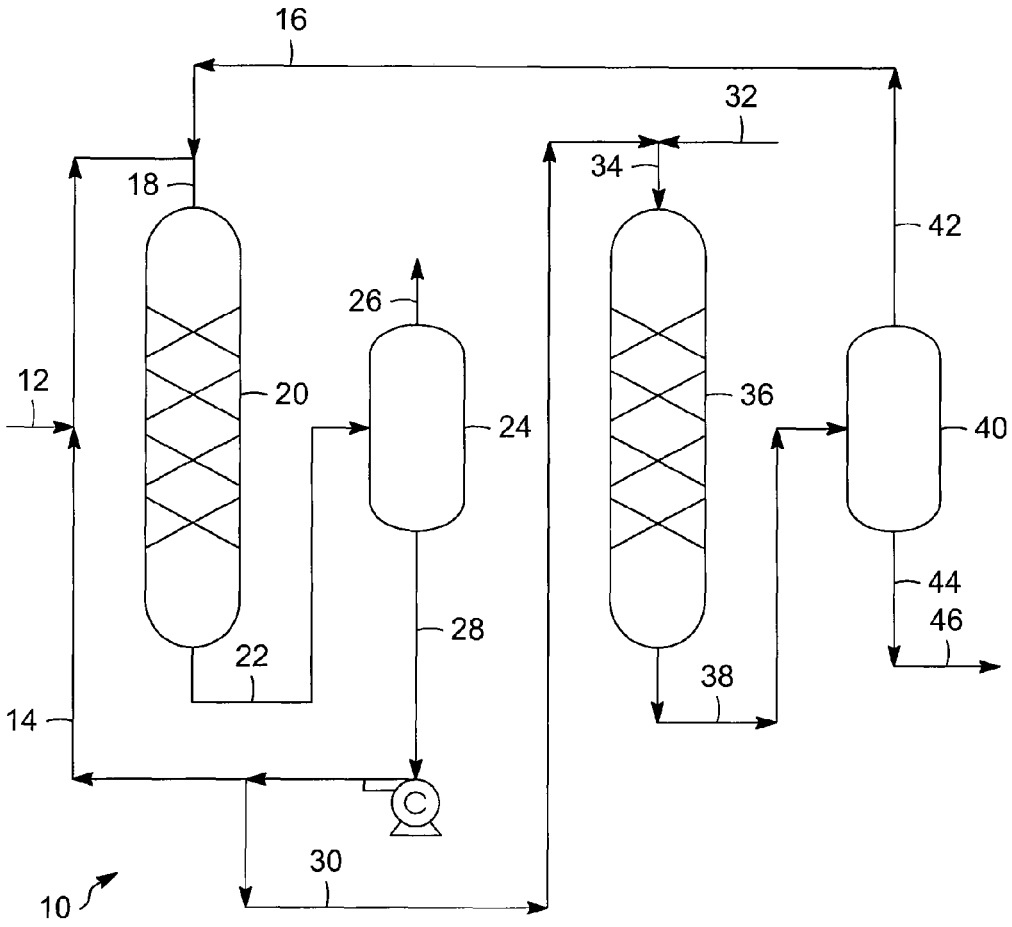
16
32
34
18
42
26
12
20
36
24
40
44
46
28
22
38
14
30
10

THREE-PHASE HYDROPROCESSING WITHOUT A RECYCLE GAS COMPRESSOR

FIELD OF THE INVENTION

The field generally relates to hydroprocessing of hydrocarbon streams and, more particularly, to hydroprocessing using three-phase hydroprocessing zones.

BACKGROUND OF THE INVENTION

Petroleum refiners often produce desirable products such as turbine fuel, diesel fuel, middle distillates, naphtha, and gasoline, among others, by hydroprocessing a hydrocarbonaceous feed stock derived from crude oil or heavy fractions thereof. Hydroprocessing can include, for example, hydrocracking, hydrotreating, hydrodesulphurization and the like. Feed stocks subjected to hydroprocessing may include atmospheric gas oils, vacuum gas oils, heavy gas oils, and other hydrocarbon streams recovered from crude oil by distillation. For example, a typical heavy gas oil comprises a substantial portion of hydrocarbon components boiling above about 371° C. (700° F.) and usually at least about 50 percent by weight boiling above 371° C. (700° F.), and a typical vacuum gas oil normally has a boiling point range between about 315° C. (600° F.) and about 565° C. (1050° F.).

Hydroprocessing uses a hydrogen-containing gas with suitable catalyst(s) for a particular application. In many instances, hydroprocessing is accomplished by contacting the selected feed stock in a reaction vessel or zone with the suitable catalyst under conditions of elevated temperature and pressure in the presence of hydrogen as a separate phase in a three-phase system (i.e., hydrogen gas, a liquid hydrocarbon stream, and a solid catalyst). Such hydroprocessing systems are commonly undertaken in a trickle-bed reactor where the continuous phase throughout the reactor is gaseous.

In such trickle-bed reactors, a substantial excess of the hydrogen gas is present in the reactor to form the continuous gaseous phase. In many instances, a typical trickle-bed hydrocracking reactor requires up to about 10,000 SCF/B of hydrogen at pressures up to 17.3 MPa (2500 psig) to effect the desired reactions. In these systems, because the continuous phase throughout the reactor is the gas-phase, large amounts of excess hydrogen gas are generally required to maintain this continuous phase throughout the reactor vessel. However, supplying such large supplies of gaseous hydrogen at the operating conditions needed for hydroprocessing adds complexity, and capital and operating expense to the hydroprocessing system.

In order to supply and maintain the needed amounts of hydrogen in a continuous gas-phase system, the effluent from the trickle-bed reactor is commonly subject to separation into a gaseous component containing hydrogen and a liquid component. The gaseous component is directed to a compressor and then recycled back to the reactor inlet to assist in supplying the large amounts of hydrogen gas needed to maintain the reactors continuous gaseous phase. Conventional trickle-bed hydrocracking units typically operate up to about 17.3 MPa (2500 psig) and, therefore, require the use of a high-pressure recycle gas compressor in order to provide the recycled hydrogen at necessary elevated pressures. Often such hydrogen recycle can be up to about 10,000 SCF/B, and processing such quantities of hydrogen through a high-pressure compressor adds complexity, increased capital costs, and increased operating costs to the hydrocracking unit. In general, the recycle gas system may represent as much as about 15 to about 30 percent of the cost of a hydroprocessing unit.

In order to eliminate the costly recycle gas compressor, it is has been proposed to use a two-phase hydroprocessing system (i.e., a liquid hydrocarbon stream and solid catalyst) where the continuous phase throughout the reactor is liquid rather than gas. These two-phase systems generally only use enough hydrogen dissolved in the liquid-phase to saturate the liquid in the reactor so a recycle of hydrogen gas is not required, which avoids the use of the recycle gas compressor. However, to ensure that sufficient amounts of hydrogen are dissolved in the liquid phase relative to the unconverted oil to effect the desired reactions, a hydrogen containing diluent liquid is often introduced with the feed so that the ratio of dissolved hydrogen to unconverted oil is high enough to complete the desired reactions at an acceptable rate.

While two-phase systems can operate without a costly recycle gas compressor, the reactions in such two-phase systems are generally less efficient with less contact between the unconverted oil and the catalyst than similar reactions in the more common three-phase systems. For example, with a given amount of catalyst, the contact time of the unconverted oil in the feed with the catalyst in the three-phase system is substantially greater than the contact time of the unconverted oil with catalyst in the liquid-phase system. Generally due to the diluents in the feed of the liquid-phase systems, the contact time of the unconverted oil with the catalyst is reduced substantially because so much of the feed is diluent. As a result, the reaction rates in the liquid-phase systems are less efficient and reduced from those in a three-phase system with a similar amount of catalyst.

SUMMARY OF THE INVENTION

In general, methods of hydroprocessing a hydrocarbonaceous feed stock are provided that combine a substantially liquid-phase hyroprocessing zone with a substantially three-phase hydroprocessing zone. The supply of the hydrogen requirements for both reaction zones is provided from an external supply source of hydrogen primarily to the substantially three-phase hydroprocessing zone. The use of a recycle gas compressor to supply hydrogen at elevated pressures to the system is unnecessary and can be eliminated at a substantial cost savings, with overall improvements to the capital effectiveness of the system and reduction in required utilities.

In one aspect, a method of processing a hydrocarbonaceous feed stock is provided that directs the feed stream to a substantially liquid-phase hydroprocessing zone to form a first effluent. The substantially liquid-phase hydroprocessing zone has a first hydrogen requirement and is maintained in a substantially continuous liquid-phase throughout. Although this hydroprocessing zone is a substantially continuous liquid-phase, the first effluent contains hydrogen in excess of the chemical hydrogen consumption such that two phases are minimally maintained in the reactor effluent. At least a portion of the effluent from the liquid-phase hydroprocessing zone is directed to the substantially three-phase hydroprocessing zone to form a second effluent. The substantially three-phase hydroprocessing zone has a second hydrogen requirement effective to maintain the substantially three-phase hydroprocessing zone with a substantially continuous gas-phase throughout and to provide the excess hydrogen in the second effluent. The excess hydrogen in the second effluent contains the first hydrogen requirement, which is the hydrogen required for chemical consumption, plus the excess hydrogen required to minimally maintain two phases in the aforementioned first effluent.

In one such aspect, both the first hydrogen requirement and the second hydrogen requirement may be obtained from an external source, such as a make-up hydrogen system. The make up hydrogen flow may be supplied directly to the three-phase hydroprocessing zone and is supplied in an amount sufficient to satisfy the requirements of the substantially three-phase reaction zone. The make up hydrogen flow also provides excess hydrogen in an amount sufficient to satisfy the requirements of the substantially liquid-phase hydroprocessing zone. These requirements for this substantially liquid-phase hydrocarbon phase include the hydrogen required for chemical hydrogen consumption plus the excess hydrogen required to minimally maintain two phases in the first effluent. The hydrogen consumption for the substantially continuous liquid-phase reaction zone is generally greater than the hydrogen consumption for the substantially three-phase reaction zone. The overall unit hydrogen requirement is supplied directly to the substantially three-phase reaction zone. Thus, the first hydrogen requirement may be extracted from the excess hydrogen present in the second effluent. Accordingly, the methods and system satisfy both the first and second hydrogen requirements without using a hydrogen recycle gas compressor or other high pressure hydrogen supply.

Other embodiments encompass further details of the process, such as preferred feed stocks, catalysts, and operating conditions to provide but a few examples. Such other embodiments and details are hereinafter disclosed in the following discussion of various aspects of the process.

BRIEF DESCRIPTION OF THE DRAWINGS

FIG. 1 is an exemplary flow chart of a hyroprocessing system.

DETAILED DESCRIPTION

The processes and system described herein are particularly useful for hydroprocessing a hydrocarbonaceous feed stock containing hydrocarbons, which may contain other organic materials, to produce a product containing hydrocarbons or other organic materials of lower average boiling point, lower average molecular weight, as well as reduced concentrations of contaminates, such as sulfur and nitrogen and the like. In one aspect, the present hydroprocessing methods combine a substantially liquid-phase hydroprocessing reaction zone with a substantially three-phase hydroprocessing reaction zone. The effluent from the substantially three-phase reaction hydroprocessing zone contains excess hydrogen to minimally maintain two phases in the effluent. The effluent from the three-phase reaction zone is directed to the substantially liquid phase reaction zone, where the hydrogen in effluent satisfies the hydrogen requirement for the liquid phase reactions. The hydrogen requirements for both reaction zones are primarily provided from an external source, which supplies a hydrogen feed to the substantially three-phase reaction zone, without the use of a hydrogen recycle gas compressor.

In another aspect, the substantially liquid-phase reaction zone provides a hydrotreatment of the hydrocarbonaceous feed stock removing a substantial amount of the heteroatom and contaminants (for example, hydrogen sulfides and ammonia compounds) from the process flow under the liquid-phase reaction conditions. The three-phase reaction zone further provides additional hydrotreating, or other hydroprocessing (such as hydrocracking) of the hydrotreated liquid process stream.

As the flow is essentially pre-treated, the three-phase reaction zone can more efficiently and effectively remove more of the heteroatom or contaminants from the process flow with the increased efficiencies of the three-phase reactors system, and with reduced concerns due to catalyst poisoning or efficiency reductions due to significant contamination of the process flow. Such benefits of the initial treatment using a liquid-phase reactor also may apply to other hydroprocessing treatments in the three-phase reaction zone. Thus, the method and system provides the benefits of substantially two-phase and three-phase reaction zones, without the additional expense and operational complications presented by hydrogen gas recycle compressors.

The hydrocarbonaceous feed stocks comprise mineral oils and synthetic oils (e.g., shale oil, tar sand products, etc.) and fractions thereof that may be subjected to hydroprocessing and hydrocracking. Illustrative hydrocarbon feed stocks include those containing components boiling above about 149° C. (300° F.), such as atmospheric gas oils, vacuum gas oils, deasphalted, vacuum, and atmospheric residua, hydrotreated or mildly hydrocracked residual oils, coker distillates, straight run distillates, solvent-deasphalted oils, pyrolysis-derived oils, high boiling synthetic oils, cycle oils and cat cracker distillates. One preferred feed stock is a gas oil or other hydrocarbon fraction having at least about 50 weight percent, and preferably at least about 75 weight percent, of its components boiling at a temperature above about 371° C. (700° F.). For example, another preferred feed stock contains hydrocarbon components which boil above about 288° C. (550° F.) with at least about 25 percent by volume of the components boiling between about 315° C. (600° F.) and about 565° C. (105° F.). Other suitable feed stocks may have a greater or lesser proportion of components boiling in such range.

In such aspects of the methods and systems, a liquid hydrocarbonaceous feed stream is provided comprised of one or more hydrocarbonaceous feed stocks. As discussed below, the feed stream may be supplemented with a hydrogen containing portion of the liquid hydrocarbonaceous effluent from the substantially liquid-phase hydroprocessing zone and a hydrogen supply from the three-phase reaction zone to ensure that the hydrogen requirement of the substantially liquid-phase reaction zone is satisfied. The hydrogen requirement of the substantially liquid-phase reaction zone is the hydrogen required for chemical hydrogen consumption plus excess hydrogen required to minimally maintain the reactor effluent in two phases. The added liquid effluent and added hydrogen may be admixed with the hydrocarbonaceous feed stream upstream of the first substantially liquid-phase hydroprocessing zone.

In other aspects, the added hydrogen stream may be supplied to the substantially liquid phase hydroprocessing zone and may be provided from other sources, such as a make-up hydrogen source. The added liquid effluent is a liquid recycle stream obtained from the effluent of the substantially liquid-phase reaction zone. Such liquid recycle may function as a diluent in the liquid feed stream to insure the sufficient dissolved hydrogen is present relative to the unconverted oil and also may help satisfy the hydrogen requirement for the substantially liquid phase reaction zone due to dissolved hydrogen in the liquid recycle stream.

The liquid hydrocarbonaceous feed stream, which may include an admixture of the hydrocarbonaceous feed stock, the liquid recycle effluent and the added hydrogen, initially is introduced into the substantially liquid-phase hydroprocessing zone. The first substantially liquid-phase reaction zone, with a first hydrogen requirement, is preferably in one aspect maintained with a substantially continuous liquid-phase throughout the zone as described below.

In such one aspect, the liquid-phase reaction zone is a substantially liquid-phase hydrotreating zone operated under hydrotreating conditions to produce a first effluent including hydrogen sulfide and ammonia and minimal excess hydrogen such that two phases are present in the reactor effluent. In this aspect, the liquid-phase hydrotreating reaction conditions for the hydroprocessing zone may include a temperature from about 204° C. (400° F.) to about 482° C. (900° F.), a pressure from about 3.5 MPa (500 psig) to about 16.5 MPa (2400 psig), a liquid hourly space velocity of the fresh hydrocarbonaceous feed stock from about 0.1 $hr^{-1}$ to about 10 $hr^{-1}$ with a hydrotreating catalyst or a combination of hydrotreating catalysts. Other conditions may also be used depending on the specific feeds, catalysts, and composition of the effluent stream desired.

In the substantially liquid-phase hydrotreating zone, the first hydrogen requirement therein is substantially satisfied by the hydrogen dissolved in the liquid feed stream and is used in the presence of suitable catalyst(s) that are primarily active for the removal of heteroatoms, such as sulfur and nitrogen, from the hydrocarbon feed stock. In one such aspect, suitable hydrotreating catalysts for use in the present invention are conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina.

Other suitable hydrotreating catalysts include zeolitic catalysts, as well as noble metal catalysts where the noble metal is selected from palladium and platinum. In another aspect, more than one type of hydrotreating catalyst may be used in the same reaction vessel. In such aspect, the Group VIII metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent.

In yet another aspect, the liquid feed stream into the substantially liquid-phase hydrotreating zone is substantially saturated with hydrogen prior to being introduced to the substantially liquid-phase hydrotreating zone. In this aspect, the first hydrogen requirement is satisfied by the addition of an amount of hydrogen to the feed stream in excess of that required to saturate the liquid, such that the liquid feed stream to the substantially liquid-phase hydrotreating reaction zone has a small vapor phase throughout. In one such aspect, the small vapor phase due to the amount of hydrogen added to the feed stream is sufficient to maintain a substantially constant level of dissolved hydrogen in the liquid throughout the liquid-phase reaction zone as the reaction proceeds.

Thus, as the treatment of the feed proceeds in the liquid-phase reaction zone and consumes the dissolved hydrogen, there is sufficient additional hydrogen in the small gas phase to continuously provide additional hydrogen that dissolves back into the liquid-phase to provide a substantially constant level of dissolved hydrogen (such as generally provided by Henry's law, for example). The liquid-phase in the reaction zone, therefore, may remain substantially saturated with hydrogen even as the reaction consumes dissolved hydrogen. Such a substantially constant level of dissolved hydrogen is advantageous because it provides a generally constant reaction rate in the liquid-phase reactors and can overcome the hydrogen depletion that can be a problem in prior liquid-phase systems.

In such aspects, the amount of hydrogen added to the feed stream into the hydrotreating zone will generally range from an amount to saturate the stream to an amount (based on operating conditions) where the stream is generally at a transition from a liquid to a gas phase, but still has a larger liquid phase than a gas phase. In one aspect, for example, the amount of hydrogen will preferably range from about 100 to about 150 percent of the saturated feed stream and, in other cases, range from about 125 to about 150 percent of saturation. In yet other aspects, it is expected that the amount of hydrogen may be up to about 500 percent of saturation to about 5000 percent of the saturated feed stream.

In some instances, the substantially liquid-phase hydrotreating zone will generally have greater than about 10 percent hydrogen gas by volume and, in other cases, greater than about 25 percent hydrogen gas by volume of the reactors in the hydrotreating zones. In one example of such an aspect, about 100 to about 800 SCF/B of hydrogen will be added to the liquid feed stream into the substantially liquid-phase hydrotreating zone in order to maintain the substantially constant saturation of hydrogen throughout the liquid-phase reactor to enable the hydrotreating reactions. It will be appreciated, however, that the amount of hydrogen added to the feed can vary depending on the feed composition, operating conditions, desired output, and other factors.

The relative amount of hydrogen added to the feed stream, while maintaining a substantially liquid-phase continuous system, is dependent upon the specific composition of the hydrocarbonaceous feed stock, the desired conversion rates, the reaction zone temperature and pressure, and related conditions. The appropriate amount of hydrogen required will depend on the amount necessary to provide the desired reaction efficiency and effectiveness while maintaining a substantially liquid-phase continuous system.

During the reactions occurring in the above-mentioned hydrotreating reaction zone, hydrogen is necessarily consumed. In some cases, the extra hydrogen admixed into the feed beyond that required for saturation can replace the consumed hydrogen to generally sustain the reaction. In other instances, additional hydrogen also can be added to the system through one or more hydrogen inlet points. With this option, the amount of hydrogen added at these locations is controlled to ensure that the system operates as a substantially liquid-phase continuous system. For example, the additional amount of hydrogen added using the reactor inlet points is generally an amount that maintains the saturated level of hydrogen and, in some cases, an additional amount in excess of saturation as described above. Such further added hydrogen may be supplied from the hydrogen flow obtained from the three-phase reaction zone, from a make-up hydrogen source or from another source that does not require a recycle hydrogen compressor.

The effluent from the first, substantially liquid-phase reaction zone preferably is directed to a separation zone, such as a high pressure flash vessel, where any vapor formed in the substantially liquid-phase hydroprocessing zone can be separated from a liquid phase. By one approach, the high pressure flash vessel operates at a temperature from about 232° C. (450° F.) to about 468° C. (875° F.), a pressure from about 3.5 MPa (500 psig) to about 16.5 MPa (2400 psig) to separate such streams. This separation zone is configured to separate any vapors materials (such as gaseous hydrogen, hydrogen sulfide, ammonia, and/or C1 to C4 gaseous hydrocarbons and the like), which can then be directed to a recovery system. In general, any dissolved hydrogen in the separated liquid stream remains dissolved therein at the pressures and temperatures of the separation zone.

In one aspect, mentioned above, the resultant liquid stream from the above-described flash vessel, which contains an amount of dissolved hydrogen, may be recycled back to the liquid hydrocarbonaceous feed stream to the substantially liquid-phase hydrotreating zone to provide a diluent and hydrogen source for the feed stream. In one such aspect, the ratio of fresh hydrocarbonaceous feed stock to liquid-recycle (i.e., the liquid-phase hydrocarbonaceous effluent) may be about 1:0.5 to about 1:10 and, in other cases, may be about 1:0.5 to about 1:5. Thus, by blending this liquid recycle (with an amount of hydrogen already dissolved therein) into the liquid feed stream to the substantially liquid-phase hydrotreating zone, the amount of additional hydrogen from other sources that must be supplied and incorporated in the liquid feed or that may be supplied directly to the liquid-phase hydrotreating reaction zone to satisfy the hydrogen requirement of that zone may be reduced.

In another aspect of the method and system, at least a portion of the liquid effluent from the high pressure separator is directed downstream to a substantially three-phase hydroprocessing zone to be further treated. The substantially three-phase hydroprocessing zone has a hydrogen requirement effective to maintain the substantially three-phase hydroprocessing zone with a substantially continuous gas-phase throughout the reaction zone and to provide the excess hydrogen in the second effluent. The excess hydrogen in the second effluent contains the first hydrogen requirement, which is the hydrogen required for chemical consumption, plus the excess hydrogen required to minimally maintain two phases in the aforementioned first effluent. The substantially three-phase hydroprocessing zone, for example, may be a hydrotreating zone, a hydrocracking zone, or another conversion zone that forms a second effluent, which contains excess hydrogen due to the operation of the substantially three-phase zone in a continuous gas phase.

In such an aspect, the feed to the substantially three-phase hydroprocessing zone includes a portion of the liquid effluent from the first, substantially liquid-phase reaction zone after the effluent is subjected to the upstream high pressure separator. The separated liquid effluent may be combined with an amount of hydrogen provided from an external hydrogen source, such as a hydrogen-rich gaseous stream from a make-up hydrogen system. Preferably, the added hydrogen to the liquid effluent stream is sufficient to supply the hydrogen requirement for the substantially three-phase reaction zone, and to provide the excess hydrogen in the second effluent from three-phase reaction zone. As mentioned above, the excess hydrogen may be separated from the second effluent and used to supply a hydrogen stream to the feed for the first, liquid-phase reaction zone or the liquid-phase reaction zone itself.

In one form, the substantially three-phase reaction zone is a second stage hydrotreating reaction zone operated as a trickle bed reactor using between about 500 and about 1,500 SCF/B hydrogen and without a recycle gas stream or a recycle gas compressor to supply the second hydrogen requirement. In this form, the second stage hydrotreating reactor reduces the concentration of sulfur and nitrogen in the initial hydrocarbonaceous feed and will preferably include similar catalysts and operating conditions as described above.

In such an aspect, the liquid effluent directed to the substantially three-phase hydroprocessing zone has had a significant amount of, and in some instances most of, the hetroatoms and contaminants, such as hydrogen sulfides and ammonia compounds, removed as a result of its treatment in the liquid-phase reactor zone. Accordingly, the treatment of the process flow in the three-phase, hydrotreating reactor is more efficient, as the potential for hydrogen sulfide or other poisoning of the catalyst bed is reduced. For similar reasons, the hydrogen requirement of the three-phase reactor can be reduced such that a hydrogen recycle compressor is not necessary to provide the volume of hydrogen flow required for the three-phase reactor. Such benefits of the product treatment in the substantially liquid-phase reactor also applies for other hydroprocessing processes in the three-phase reactors.

In another aspect, the substantially three-phase reaction zone is a hydrocracking reaction zone, such as a mild hydrocracking zone, which is also operated as a trickle bed reactor using between about 500 and about 1,500 SCF/B hydrogen and without a recycle gas stream or a recycle gas compressor to supply the hydrogen requirements for the three-phase reaction zone. In each of these aspects, the hydrogen requirements for the three-phase reaction zone (which as further described below is greater than the requirements for the liquid-phase reaction zone) is, in one aspect, exclusively supplied from the external hydrogen source, such as a hydrogen make-up system.

If the substantially three-phase hydroprocessing zone is the above described hydrocracking zone, this zone may contain one or more hydrocracking catalysts. Depending on the desired output, the hydrocracking zone may contain one or more beds of the same or different catalyst. In one aspect, for example, when the preferred products are middle distillates, the preferred hydrocracking catalysts utilize amorphous bases or low-level zeolite bases combined with one or more Group VIII or Group VIB metal hydrogenating components. In another aspect, when the preferred products are in the gasoline boiling range, the hydrocracking zone contains a catalyst which comprises, in general, any crystalline zeolite cracking base upon which is deposited a minor proportion of a Group VIII metal hydrogenating component. Additional hydrogenating components may be selected from Group VIB for incorporation with the zeolite base.

The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and about 14 Angstroms ($10^{-10}$ meters). It is preferred to employ zeolites having a relatively high silica/alumina mole ratio between about 3 and about 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8-12 Angstroms ($10^{-10}$ meters), wherein the silica/alumina mole ratio is about 4 to 6. One example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006 B1.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. In one aspect, the preferred cracking bases are those which are at least about 10 percent, and preferably at least about 20 percent, metal-cation-deficient, based on the initial ion-exchange capacity. In another aspect, a desirable and stable class of zeolites is one wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and about 30 percent by weight may be used. In the case of the noble metals, it is normally preferred to use about 0.05 to about 2 weight percent.

The method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., about 371° C. to about 648° C. (about 700° F. to about 1200° F.) in order to activate the catalyst and decompose ammonium ions. Alternatively, the zeolite component may first be pelleted, followed by the addition of the hydrogenating component and activation by calcining.

The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between about 5 and about 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 B1 (Klotz).

The hydrocracking in contact with a hydrocracking catalyst is conducted in the presence of hydrogen while maintaining a substantially gas-phase continuous system and preferably at hydrocracking conditions. Such reactions can be completed in a trickle-bed reactor operated at hydrocracking conditions. By one approach, the hydrocracking conditions may include a temperature from about 232° C. (450° F.) to about 468° C. (875° F.), a pressure from about 3.5 MPa (500 psig) to about 16.5 MPa (2400 psig) and a liquid hourly space velocity (LHSV) from about 0.1 to about 30 $hr^{-1}$. In some aspects, the hydrocracking reaction provides substantial conversion to lower boiling products, which may be the conversion of at least about 5 volume percent of the fresh feed stock to products having a lower boiling point than the feed to the second reaction zone. In other aspects, the per pass conversion in the hydrocracking zone is in the range from about 15 percent to about 70 percent and, preferably, the per-pass conversion is in the range from about 20 percent to about 60 percent. As a result, the ratio of unconverted hydrocarbons boiling in the range of the hydrocarbonaceous feed stock to the hydrocarbonaceous feed stock is from about 1:5 to about 3:5. In one aspect, the processes herein are suitable for the production of naphtha, diesel or any other desired lower boiling hydrocarbons.

In another aspect of the method, the effluent from the substantially three-phase hydroprocessing zone is directed to a second high pressure separator to separate a vapor stream from a product stream, which may include LPG components, light and heavy naphtha, distillate such as kerosene and diesel, as well as unconverted oil or hydrotreated vacuum gas oil. In one approach, the second high pressure separator may also be a high pressure flash vessel operating at a temperature from about 232° C. (450° F.) to about 468° C. (875° F.), a pressure from about 3.5 MPa (500 psig) to about 16.5 MPa (2400 psig) to separate such streams. This second separation zone is configured to separate any vapors materials (such as gaseous hydrogen, hydrogen sulfide, ammonia, and/or C1 to C4 gaseous hydrocarbons and the like).

The vapor stream from the three-phase hydroprocessing reaction zone may be subjected to further separation and contaminant removal as needed to form a hydrogen-rich vapor stream. As mentioned above, that stream then may be admixed with the liquid feed to the substantially liquid phase hydroprocessing reaction zone (or the feed constituents). The hydrogen-rich vapor stream added to the liquid feed stream constitutes the supply of the hydrogen requirements for the substantially liquid-phase reaction zone.

In another aspect, the substantially three-phase reaction zone operates at a higher pressure than the substantially liquid-phase reaction zone so that the separated hydrogen-rich vapor phase may be routed to the liquid-phase reaction zone utilizing the pressure drop therebetween. In this manner, pumps, compressors, and other fluid transfer equipment are not needed to supply to hydrogen to the substantially liquid-phase reaction zone. By one approach, the substantially three-phase reaction zone operates at least 0.69 MPa (100 psig) greater, and in some cases, between 0.69 MPa (100 psig) and 1.03 MPa (150 psig) greater than the pressure of the substantially liquid-phase reaction zone. However, the pressure difference will vary depending on the various feeds being processed, desired outputs, and other factors.

In yet another aspect of the methods described herein, the first hydrogen requirement, i.e., that necessary to maintain activity of the substantially continuous liquid-phase reaction zone is generally less than, and in some cases substantially less than, the second hydrogen requirement to maintain a substantially continuous gas-phase throughout the substantially three-phase reaction zone. Because the first hydrogen requirement may be satisfied, in part, by the excess hydrogen extracted from the effluent from the substantially three-phase reaction zone, the required large supply of hydrogen necessary to maintain the continuous gaseous phase in the three-phase reaction zone also provides the excess hydrogen carried in the second effluent. The excess hydrogen in the second effluent provides or may provide in part the hydrogen requirement for the substantially continuous liquid-phase reaction zone.

In an alternative aspect, the hydrogen requirements obtained from the external hydrogen source, which can be the hydrogen make-up system, could be split between the feed to the substantially liquid-phase hydroprocessing zone and the feed to the substantially three-phase hydroprocessing zone. In one such approach, about 50 to about 100 percent, and in other approaches, about 75 to about 100 percent, of the make-up hydrogen could be supplied to the substantially three-phase hydroprocessing zone, and the remainder of the make-up hydrogen could be supplied to the feed of the substantially liquid-phase reaction zone. While such a flowscheme could operate as described above without the recycle gas compressor, this alternative method would not be as efficient as providing all the added hydrogen from a hydrogen make-up system to the substantially three-phase reaction zone up front with stream 32 because the reduced amounts of hydrogen in the three-phase reaction zone and may tend to increase the partial pressures of various contaminants, such as ammonia and hydrogen sulfide, and could lower the effectiveness of the various catalysts in that zone.

DETAILED DESCRIPTION OF THE DRAWING FIGURE

Turning to FIG. 1, an exemplary hydroprocessing process that eliminates the use of a recycle gas compressor but still gains the efficiency of three-phase operation will be described in more detail. It will be appreciated by one skilled in the art that various features of the above described process, such as pumps, instrumentation, heat-exchange and recovery units, condensers, compressors, flash drums, feed tanks, and other ancillary or miscellaneous process equipment that are traditionally used in commercial embodiments of hydrocarbon conversion processes have not been described or illustrated. It will be understood that such accompanying equipment may be utilized in commercial embodiments of the flow schemes as described herein. Such ancillary or miscellaneous process equipment can be obtained and designed by one skilled in the art without undue experimentation.

With reference to FIG. 1, an integrated processing unit 10 is illustrated where a hydrocarbonaceous feed stock, which preferably comprises an atmospheric gas oil, a vacuum gas oil or a heavy gas oil, is introduced into the process via line 12 and admixed with a portion of a hereinafter described substantially liquid-phase hydrotreating zone effluent transported via line 14. A hydrogen-rich gaseous stream is provided via line 16 and also joins the feed stock 12 and the resulting admixture is a liquid feed stream transported via line 18 and introduced into a substantially liquid-phase hydrotreating zone 20 in one or more reaction vessels. If needed, additional hydrogen can be introduced into substantially liquid-phase hydrotreating zone 20 via optional injection points in the reactor vessel(s).

A resulting effluent stream is removed from the hydrotreating zone 20 via line 22 and transported via line 22 into a separation zone 24 to separate a vaporous stream containing hydrogen, hydrogen sulfides, and ammonia compounds from the separation zone 24 via line 26 and recovered. A liquid stream containing converted hydrocarbons is removed from separation zone 24 via line 28 and a portion thereof is recycled to the feed stock 12 via line 14 as previously described. In one embodiment, a ratio of fresh feed stock 12 to liquid recycle 14 is about 1:0.5 to about 1:10.

A portion of the liquid stream 28 is separated into line 30 and joined with a second hydrogen-rich gaseous stream provided via line 32 in an amount to maintain a substantially gas-phase continuous system. The amount of hydrogen in line 32 is generally sufficient to satisfy the first and second hydrogen requirements without the use of hydrogen recycle and associated compressors as previously described. The resulting admixture is transported via line 34 and introduced into a substantially gas-phase continuous reaction zone 36 (for example, a hydrotreating zone or hydrocracking zone). If necessary, additional hydrogen can be provided to the reaction zone 36 via optional inlet ports if needed.

A resulting effluent stream is removed from the reaction zone 36 via line 38 and transported via line 38 into a second separation zone 40 to remove any lighter products that may flash at the conditions of the hydrotreating or hydrocracking reactor. A hydrogen-rich vaporous stream is removed from the separation zone 40 via line 42 and recycled to the feed stock 12 via line 16 as previously described. A liquid stream containing converted hydrocarbons is removed from the separation zone 40 via line 46. A liquid product draw may be siphoned off the bottoms of the separation zone 40 via line 46.

The foregoing description of the drawing clearly illustrates the advantages encompassed by the processes described herein and the benefits to be afforded with the use thereof. In addition, FIG. 1 is intended to illustrate but one exemplary flow scheme of the processes described herein, and other processes and flow schemes are also possible. It will be further understood that various changes in the details, materials, and arrangements of parts and components which have been herein described and illustrated in order to explain the nature of the process may be made by those skilled in the art within the principle and scope of the process as expressed in the appended claims.

What is claimed is:

1. A method of processing a hydrocarbonaceous feed stock comprising:

directing a feed stream to a substantially continuous liquid-phase hydroprocessing zone to form a first effluent, the substantially continuous liquid-phase hydroprocessing zone having a first hydrogen requirement;

directing at least a portion of the first effluent to a substantially three-phase hydroprocessing zone to form a second effluent, the substantially three-phase hydroprocessing zone having a second hydrogen requirement effective to maintain the substantially three-phase hydroprocessing zone in a substantially continuous gas phase throughout and to provide an excess amount of hydrogen in the second effluent;

supplying a hydrogen stream from an external make-up hydrogen system to provide the second hydrogen requirement; and separating the excess hydrogen present in the second effluent from the substantially three-phase hydroprocessing zone as a flow of hydrogen, and directing the hydrogen flow to the substantially continuous liquid-phase hydroprocessing zone to provide a hydrogen supply for the first hydrogen requirement.

2. The method of claim 1, further comprising separating the first effluent into a first liquid effluent having a quantity of hydrogen dissolved therein and a first vapor effluent;

recycling a portion of the first liquid effluent to the feed stream to the substantially continuous liquid-phase hydroprocessing zone; and separating the second effluent into a hydrogen-rich vapor stream and a hydrocarbonaceous product stream, the hydrogen-rich vapor stream directed to the substantially continuous liquid-phase hydroprocessing zone, the dissolved hydrogen in the recycled first liquid effluent and the hydrogen-rich vapor stream providing a hydrogen supply satisfying the first hydrogen requirement.

3. The method of claim 1, wherein the first hydrogen requirement oversaturates the feed stream into the continuous liquid-phase hydroprocessing zone with hydrogen.

4. The method of claim 1, wherein the substantially three-phase hydroprocessing zone operates at a pressure at least about 100 psi greater than the pressure of the substantially continuous liquid-phase hydroprocessing zone.

5. The method of claim 4, wherein the hydrogen flow to satisfy the first hydrogen requirement is provided by the pressure drop between the substantially three-phase hydroprocessing zone and the substantially continuous liquid-phase hydroprocessing zone.

6. The method of claim 1, wherein the substantially continuous liquid-phase hydroprocessing zone is a hydrotreating zone.

7. The method of claim 1, wherein the substantially three-phase hydroprocessing zone includes a substantially three-phase hydrotreating or hydrocracking zone.

8. A method of processing a hydrocarbonaceous feed stock comprising:

providing an initial feed stream of at least a hydrocarbonaceous feed stock, a previously hydroprocessed liquid-phase hydrocarbonaceous stream, and a hydrogen-rich vapor stream;

directing the initial feed stream to a substantially continuous liquid-phase hydroprocessing zone to form a first effluent, the substantially continuous liquid-phase hydroprocessing zone having a first requirement of hydrogen satisfied by dissolved hydrogen in the previously hydroprocessed liquid-phase hydrocarbonaceous stream and the hydrogen-rich vapor stream;

separating the first effluent into a liquid effluent stream and a vapor effluent stream;

recycling a portion of the first liquid effluent stream to the initial feed stream to provide the previously hydroprocessed liquid-phase hydrocarbonaceous stream;

directing a portion of the first liquid effluent stream to a substantially three-phase hydroprocessing zone to form a second effluent, the substantially three-phase hydroprocessing zone having a second requirement of hydrogen effective to maintain a substantially continuous gas phase throughout the substantially three-phase hydroprocessing zone;

providing a supply of hydrogen into the substantially three-phase hydroprocessing zone sufficient to satisfy the second hydrogen requirement and to provide excess hydrogen in the second effluent;

separating the second effluent into the hydrogen-rich vapor stream and a hydrocarbonaceous product stream; and directing the hydrogen-rich vapor stream separated from the second effluent to the initial feed stream to the substantially continuous-liquid phase hydroprocessing zone; wherein an external make-up hydrogen system provides the second hydrogen requirement without a recycle compressor.

9. The method of claim 8, wherein at least about 10 percent additional hydrogen above the second hydrogen requirement is added to the substantially three-phase hydroprocessing zone.

10. The method of claim 8, wherein the substantially three-phase hydroprocessing zone operates at a pressure at least about 100 psi greater than the pressure of the substantially continuous liquid phase hydroprocessing zone.

11. The method of claim 8, wherein the substantially continuous liquid phase hydroprocessing zone includes a substantially continuous liquid phase hydrotreating zone.

12. The method of claim 8, wherein the substantially three-phase hydroprocessing zone includes a substantially three-phase hydrotreating or hydrocracking zone.

13. A method of processing a hydrocarbonaceous feed stock comprising:

providing an initial feed stream of at least a hydrocarbonaceous feed stock, a previously hydroprocessed liquid-phase hydrocarbonaceous stream, and a hydrogen-rich vapor stream;

directing the initial feed stream to a substantially continuous liquid-phase hydroprocessing zone to form a first effluent, the substantially continuous liquid-phase hydroprocessing zone having a first requirement of hydrogen satisfied by dissolved hydrogen in the previously hydroprocessed liquid-phase hydrocarbonaceous stream and the hydrogen-rich vapor stream;

separating the first effluent into a liquid effluent stream and a vapor effluent stream in a separation zone;

recycling a portion of the first liquid effluent stream from the separation zone to the initial feed stream to provide the previously hydroprocessed liquid-phase hydrocarbonaceous stream;

directing a portion of the first liquid effluent stream to a substantially three-phase hydroprocessing zone to form a second effluent, the substantially three-phase hydroprocessing zone having a second requirement of hydrogen effective to maintain a substantially continuous gas phase throughout the substantially three-phase hydroprocessing zone;

providing a supply of hydrogen into the substantially three-phase hydroprocessing zone sufficient to satisfy the second hydrogen requirement and to provide excess hydrogen in the second effluent;

separating the second effluent into the hydrogen-rich vapor stream and a hydrocarbonaceous product stream in a second separation zone; and directing the hydrogen-rich vapor stream separated from the second effluent to the initial feed stream to the substantially continuous-liquid phase hydroprocessing zone; wherein an external make-up hydrogen system provides the second hydrogen requirement without a recycle compressor.

14. The method of claim 13, wherein at least about 10 percent additional hydrogen above the second hydrogen requirement is added to the substantially three-phase hydroprocessing zone.

15. The method of claim 13, wherein the substantially three-phase hydroprocessing zone operates at a pressure at least about 100 psi greater than the pressure of the substantially continuous liquid phase hydroprocessing zone.

16. The method of claim 13, wherein the substantially continuous liquid phase hydroprocessing zone includes a substantially continuous liquid phase hydrotreating zone.

17. The method of claim 13, wherein the substantially three-phase hydroprocessing zone includes a substantially three-phase hydrotreating or hydrocracking zone.

* * * * *